US006548217B2

(12) United States Patent
Fujikura

(10) Patent No.: US 6,548,217 B2
(45) Date of Patent: Apr. 15, 2003

(54) DEVELOPING AGENT, METHOD OF MEASURING FREE COMPONENT CONTENT OF ADDITIVE IN DEVELOPING AGENT, AND METHOD OF EVALUATING DEVELOPING AGENT

(75) Inventor: Yukihiro Fujikura, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/983,236

(22) Filed: Oct. 23, 2001

(65) Prior Publication Data

US 2002/0072002 A1 Jun. 13, 2002

Related U.S. Application Data

(62) Division of application No. 09/658,381, filed on Sep. 8, 2000, now Pat. No. 6,316,154.

(30) Foreign Application Priority Data

Sep. 22, 1999 (JP) ..... 11-269266

(51) Int. Cl.[7] ..... G03G 9/00

(52) U.S. Cl. ..... 430/108.3; 430/109.1; 430/109.4

(58) Field of Search ..... 430/108.3, 109.1, 430/109.4

(56) References Cited

PUBLICATIONS

Abstract of JP410019811A, Jan. 1998.

*Primary Examiner*—Mark A. Chapman
(74) *Attorney, Agent, or Firm*—Foley & Lardner

(57) ABSTRACT

Generation of a drum filming layer is prevented by obtaining a developing agent meeting the relationship $y<0.057x+0.1748$, where x represents the total addition amount of the additive, which is not smaller than 0.2, and y represents the free component content obtained from the difference in the fluorescence X-ray analytical value between the front surface and the back surface of a pellet of the developing agent, by quantitatively analyzing the free component content of the additive to the developing agent and by using a binder resin satisfying the conditions of 2,000≦number average molecular weight≦5,000, 8,000≦weight average molecular weight≦70,000, and 1.6≦Mw/Mn≦35.

4 Claims, 2 Drawing Sheets

DEVELOPING AGENT, METHOD OF MEASURING FREE COMPONENT CONTENT OF ADDITIVE IN DEVELOPING AGENT, AND METHOD OF EVALUATING DEVELOPING AGENT

This is a Divisional Application of application Ser. No. 09/658,381, filed Sep. 8, 2000, now U.S. Pat. No. 6,316,154.

CROSS-REFERENCE TO RELATED APPLICATIONS

This application is based upon and claims the benefit of priority from the prior Japanese Patent Application No. 11-269266, filed Sep. 22, 1999, the entire contents of which are incorporated herein by reference.

BACKGROUND OF THE INVENTION

The present invention relates to a developing agent used in, for example, an electrophotographic apparatus, a method for measuring the free component content of the additive to the developing agent, and a method of evaluating the developing agent.

Various assumptions are made with respect to the filming generation in a developing agent. The presence of free silica that is not attached to the toner is considered to be one of the causes of the filming generation.

For example, where the mixing ratio of silica is unduly large, or where the additive mixing conditions are not appropriate, some of the silica particles are present in a free state separated from the toner particles. As a result, the free silica particles are attached to the carrier particles or attached to and deposited on the inner wall of the developing device, on the developing sleeve, regulating blade, etc. It is then considered that the frictional charging properties of the toner are impaired so as to make it difficult to impart an appropriate charging amount to the toner and so as to promote the filming generation.

The attached state of the additive was analyzed in the past by observation with a scanning electron microscope (SEM), transmitting electron microscope (TEM) or the like. However, these methods are dependent on the visual sensation and the analytical result is not quantitative and, thus, is vague in a large proportion.

BRIEF SUMMARY OF THE INVENTION

An object of the present invention, which has been achieved in view of the situation described above, is to provide a developing agent capable of preventing the occurrence of a drum filming layer.

Another object is to provide a method of quantitatively measuring the content of the free component of the additive to the developing agent.

Further, still another object of the present invention is to provide a method of evaluating the developing agent by quantitatively measuring the content of the free component of the additive to the developing agent.

According to a first aspect of the present invention, there is provided a developing agent, comprising toner particles containing a binder resin and a colorant, the binder resin satisfying the conditions of $2{,}000 \leqq$ number average molecular weight $Mn \leqq 5{,}000$; $8{,}000 \leqq$ weight average molecular weight $Mw \leqq 70{,}000$; and $1.6 \leqq Mw/Mn \leqq 35$, and an additive mixed with the toner particles, wherein the developing agent satisfies the relationship $y<0.057x+0.1748$, where x represents the total amount of the additive, which is not smaller than 0.2, and y represents the content of the free component of the additive.

According to a second aspect of the present invention, there is provided a method of measuring the free component content of the additive to the developing agent, comprising the steps of forming a pellet by using a developing agent; measuring the front and back surfaces of the pellet by a fluorescence X-ray analytical method, and obtaining the free component content on the basis of the difference in the measured values.

Further, according to a third aspect of the present invention, there is provided a method of evaluating a developing agent, comprising the steps of forming a pellet by using a developing agent; measuring the front and back surfaces of the pellet by a fluorescence X-ray analytical method, obtaining the free component content y on the basis of the difference in the measured values; and examining whether the total addition amount x of the additive and the free component content y meet the relationship $y<0.057x+0.1748$.

According to the present invention, it is possible to measure quantitatively the free component content of the additive mixed with the toner particles of the developing agent.

Also, the present invention makes it possible to evaluate the developing agent by quantitatively measuring the free component content of the additive added to the toner particles of the developing agent so as to select a suitable developing agent that does not generate a drum filming layer.

Further, according to the developing agent of the present invention, it is possible to prevent the drum filming layer from being generated by defining the free component content relative to the addition amount of the additive by using the method described above, making it possible to prevent the off-set occurrence and, thus, to obtain a good image.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The method of the present invention for measuring the free component content of the additive to the developing agent is featured in that pellet is formed by using the developing agent, followed by measuring the front surface and back surface of the resultant developing agent pellet by an fluorescence X-ray (XRF) analytical method so as to obtain the free component content from the difference in the measured values thus obtained.

The present invention will now be described in detail with reference to the accompanying drawings.

Figure 1:
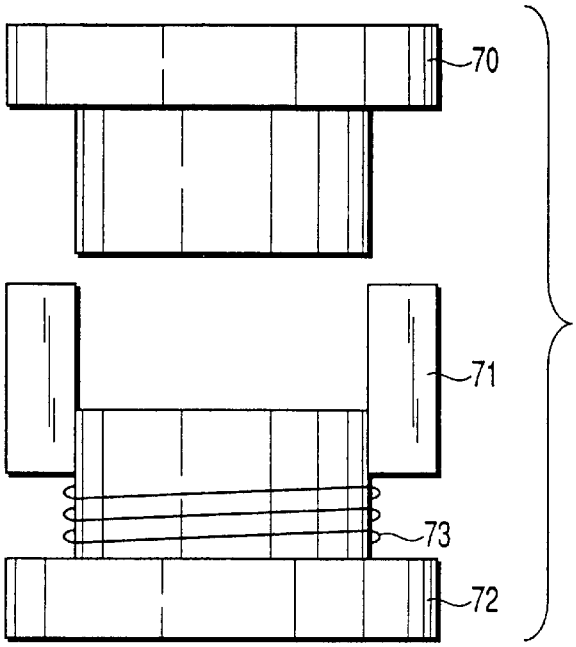
FIG. 1 schematically exemplifies a pellet manufacturing apparatus.

In the measuring method of the present invention, an analysis is performed by preparing a pellet of a developing agent. The pellet can be prepared by using a die. FIG. 1 schematically shows a die used for preparation of the pellet.

As shown in the drawing, the die comprises an upper mallet 70, a mortar 71, and a lower pounder 72 wound with a spring 73. The mortar 71 and the lower mallet 72 are assembled such that a concavity is formed in an upper portion of the assembly. A developing agent is put in the concavity and compressed from above by using the upper pounder 70 so as to manufacture a desired pellet.

Figure 2:
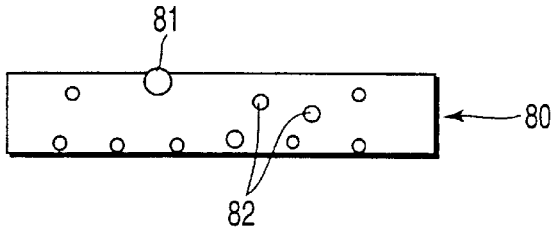
FIG. 2 shows a model for explaining the pellet used in the present invention.

FIG. 2 shows a model of the developing agent pellet 80 used for the measurement. As shown in the drawing, additive particles 82 attached sufficiently to the toner are dispersed within the pellet 80. However, free additive particles 81 tend to be exposed to the surface.

In the method of the present invention, each of the front surface and the back surface of the developing agent pellet is analyzed by a fluorescence X-ray analytical method so as to quantitatively measure the free component.

Figure 3:
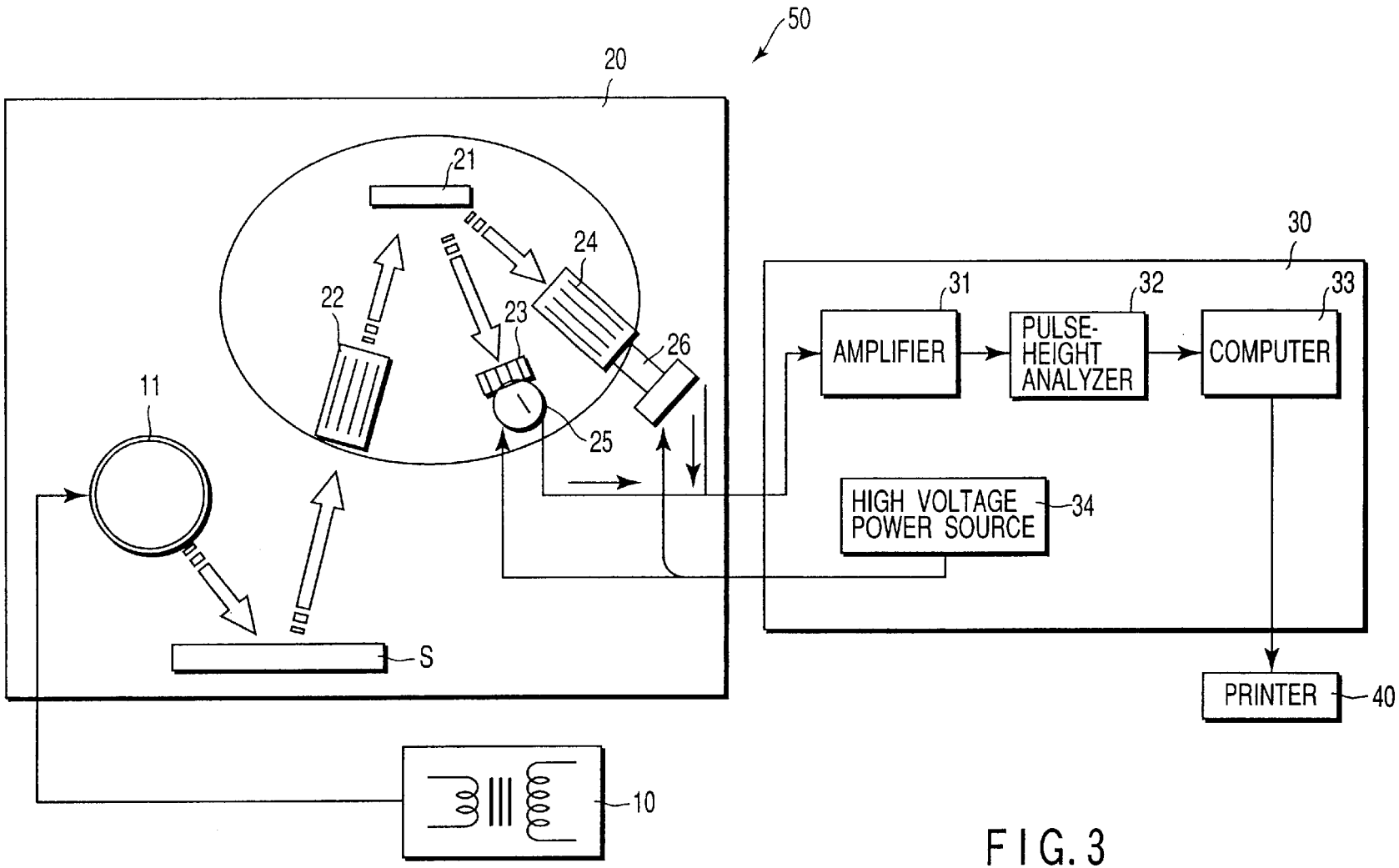
FIG. 3 schematically shows an fluorescence X-ray analytical apparatus used in the present invention.

FIG. 3 schematically shows the construction of a fluorescence X-ray analytical apparatus 50 used for the fluorescent X-ray analytical method of the present invention.

As shown in the drawing, the fluorescent X-ray analytical apparatus 50 comprises a high voltage generating device 10, a spectroscopic apparatus 20, and a recording apparatus 30.

The high voltage generating apparatus 10 is an apparatus for obtaining a stable high voltage applied to an X-ray tube 11.

The spectroscopic apparatus 20 comprises the X-ray tube 11 connected to the high voltage generating apparatus 10, a first slit 22 for selectively transmitting the fluorescence X-rays generated from a sample, a spectroscopic crystal 21, a second slit 23 and a third slit 24 for selectively transmitting two kinds of spectra differing from each other in wavelength and split by the spectroscopic crystal 21, a gas flow type proportional counter 25 for detecting the spectrum passing through the second slit 23 and the third slit 24, and a scintillation counter 26.

Further, the recording apparatus 30 includes an amplifier 31 for amplifying the signal detected by the gas flow type proportional counter 25 and the scintillation counter 26, a pulse-height analyzer 32 for analyzing the pulse-height of the output signal generated from the amplifier 31, a computer 33 for applying an arithmetic calculation to the analytical result of the pulse-height analyzer so as to present the analytical result by numeral values, and a high voltage power source 34 for applying a voltage to the gas flow type proportional counter 25 and to the scintillation counter 26.

In the fluorescence X-ray analytical apparatus 50, a high voltage is applied by the high voltage generating apparatus 10 to the X-ray tube 11 so as to generate strong X-rays. A sample S is irradiated with the strong X-rays as a primary X-ray to cause the sample S to emit fluorescent X-rays as a secondary X-ray. The fluorescent X-rays are transmitted through the first slit 22 and, then, the spectroscopic crystal 21 is irradiated with the transmitted fluorescent X-rays, with the result that the fluorescent X-rays are split. Of the spectra split by the spectroscopic crystal 21, the element spectrum corresponding to a specified element of the sample S is selectively allowed to be transmitted through the second slit 23 and the third slit 24 so as to be guided to the gas flow type proportional counter 25 and the scintillation counter 26 and, thus, to be analyzed.

Then, the signal detected by the gas flow type proportional counter 25 and the scintillation counter 26 is guided to the recording apparatus 30, in which the detected signal is amplified by the amplifier 31 and analyzed by the pulse-height analyzer 32. The result of the pulse-height analysis is calculated in the computer 33 so as to be converted into numerical values. The numerical values thus obtained is outputted to an external equipment such as a printer 40.

The difference in the analytical value between the front surface and the back surface of the pellet of the developing agent is obtained so as to measure the content of the free component.

Also, in the developing agent of the present invention, the content of the free component obtained by the measuring method described above falls within a predetermined range, and comprises toner particles containing a binder resin and a colorant, said binder resin satisfying the conditions of $2{,}000 \leqq$ number average molecular weight $Mn \leqq 5{,}000$; $8{,}000 \leqq$ weight average molecular weight $Mw \leqq 70{,}000$; and $1.6 \leqq Mw/Mn \leqq 35$, and an additive mixed with said toner particles, wherein said developing agent satisfies the relationship $y<0.057x+0.1748$, where x represents the total amount of the additive, which is not smaller than 0.2, and y represents the content of the free component of the additive.

If the addition amount x of the additive and the free component y of the additive have the relationship $y \geqq 0.057x+0.1748$, the filming is generated so as to deteriorate the image.

If the molecular weight of the binder resin used in the present invention is $Mn<2{,}000$ or $Mw<8{,}000$, the offset generating temperature is lowered. On the other hand, if the molecular weight is $5{,}000<Mn$ or $70{,}000<Mw$, the softening point is increased so as to bring about a defective fixing.

Further, if $Mw/Mn<1.6$, a high temperature offset is generated. Also, if $35<Mw/Mn$, the transparency is impaired and the fixing is made poor.

Further, in the method of the present invention for evaluating the developing agent, it is examined whether the content of the free component obtained by the measuring method described above is appropriate or not so as to determine whether the developing agent is satisfactory or not. Specifically, the evaluating method of the present invention comprises the steps of forming a pellet by using a developing agent; measuring the front and back surfaces of the pellet by a fluorescence x-ray analytical method, obtaining the free component content y on the basis of the difference in the measured values; and examining whether the total addition amount x of the additive and the free component content y meets the relationship $y<0.057x+0.1748$.

It is possible to prevent the filming generation and the deterioration of the image by evaluating in advance the developing agent.

The resin used in the present invention may be manufactured by any desired method as far as the molecular weight of the resin falls within the range specified in the present invention. Specifically, the synthetic method includes, for example, a solution polymerization, a bulk polymerization, a suspension polymerization and an emulsion polymerization.

It is desirable for the binder resin to be a thermoplastic resin including, for example, polyester, polystyrene, polyvinyl toluene, styrene-butadiene copolymer resin, styrene-acrylic acid ester copolymer resin, styrene-maleic anhydride copolymer resin, acrylic resin, xylene resin, ionomer resin, ketone resin, terpene resin, phenol-modified terpene resin, rosin, rosin-modified resin, maleic acid-modified phenolic resin, petroleum-based resin, starch graft polymer resin, polyvinyl alcohol and polyvinyl pyrrolidone.

Among the resins exemplifies above, it is particularly desirable to use a polyester resin. In order to improve the toner characteristics, it is possible to substitute trivalent or tetravalent alcohols for a part of the glycol component of the polyester resin. Likewise, it is possible to substitute trivalent or tetravalent carboxylic acid for a part of the dicarboxylic acid component of the polyester resin. To be more specific, trivalent or tetravalent alcohols such as sorbitol, hexatetrol, di-pentaerythritol, glycerol, or sugar can be substituted for a part of the glycol component of the polyester resin. Likewise, trivalent or tetravalent carboxylic acid such as benzene tri-carboxylic acid, cyclohexane tri-carboxylic acid, naphthalene tri-carboxylic, butane tri-carboxylic acid, trimellitic acid or pyromellitic acid can be substituted for a part of the di-carboxylic acid component of the polyester. By the substitution described above, a partial three dimensional crosslinking structure can be imparted to the polyester resin. It is also possible to introduce an epoxy group or an urethane bond into the polyester resin so as to form a partially crosslinked structure or a graft structure.

The di-carboxylic acid component used for the synthesis of the polyester resin includes, for example, maleic acid, fumaric acid, mesaconic acid, citraconic acid, itaconic acid, glutaconic acid, phthalic acid, isophthalic acid, terephthalic acid, cyclohexane di-carboxylic acid, succinic acid, adipic acid, sebacic acid, malonic acid, linolenic acid, as well as acid anhydrides thereof and lower alcohol ester. On the other hand, the glycol component used includes, for example, ethylene glycol, propylene glycol, butylene glycol, neopentyl glycol, hexane diol, diethylene glycol, triethylene glycol, polyethylene glycol, dimethylol benzene, cyclohexane dimethanol, bisphenol A and hydrogenated bisphenol A.

In the present invention, it is desirable to use hydrophobic silica having the surface subjected to a hydrophobic treatment as a silica fine powder. The treating agent for subjecting the surface to the hydrophobic treatment includes, for example, a silane coupling agent, silicone varnish, silicone oil, an organic silicon compound and these materials having a functional group. These treating agents are treated with the above-noted treating agents that react with or are physically adsorbed on the silica fine powder. The particular treating agent used in the present invention includes, for example, hexamethyl disilazane, trimethyl silane, trimethyl chlorosilane, triethyl ethoxy silane, dimethyl dichlorosilane, methyl trichlorosilane, allyl dimethyl chlorosilane, allyl phenyl dichlorosilane, benzyl dimethyl chlorosilane, bromomethyl dimethyl chlorosilane, α-chloroethyl trichlorosilane, β-chloroethyl trichlorosilane, chloromethyl dimethyl chlorosilane, triorganosilyl mercaptan, trimethyl silyl mercaptan, triorganosilyl acrylate, vinyl dimethyl acetoxy silane, dimethyl ethoxy silane, dimethyl dimethoxy silane, diphenyl diethoxy silane, aminopropyl trimethoxy silane, aminopropyl triethoxy silane, dimethyl aminopropyl trimethoxy silane, diethyl aminopropyl trimethoxy silane, dipropyl aminopropyl trimethoxy silane, dibutyl aminopropyl trimethoxy silane, monobutyl aminopropyl trimethoxy silane, dibutyl aminopropyl dimethyl monomethoxy silane, dimethyl aminophenyl triethoxy silane, trimethoxy silyl-γ-propyl phenyl amine, trimethoxy silyl-γ-propyl benzyl amine, trimethoxy silyl-γ-propyl piperidine, trimethoxy silyl-γ-propyl morpholine, trimethoxy silyl-γ-propyl imidazole, hexamethyl disiloxane, 1,3-divinyl tetramethyl disiloxane, 1,3-diphenyl tetramethyl disiloxane.

The coloring agent used in the present invention includes, for example, dyes and pigments such as carbon black, phthalocyanine blue, benzene yellow, benzimidazoline yellow, nigrosine dye, aniline blue, calco oil blue, chrome yellow, ultra marine blue, Du Pont oil red, quinacridone, mono-azo series pigment, disazo series pigment, diallyl series pigment, quinoline yellow, methylene blue chloride, malachite green oxalate, lamp black and rose bengal.

Also, in the present invention, more excellent offset properties can be obtained by using the binder resin having a molecular weight falling within the range described previously. The offset properties can be further improved by adding a wax component.

In the present invention, 0.1 to 10% by weight of a wax component based on the amount of the binder resin can be added to fall within a range meeting the relationship described previously.

If added in an amount smaller than 0.1% by weight, the wax component scarcely produces its effect. If the addition amount exceeds 10% by weight, however, the preservation capability of the developing agent is deteriorated. Preferably, the wax component should be used in an amount falling within a range of between 0.5 and 8% by weight.

The wax component used in the present invention includes, for example, a low molecular weight polypropylene, a low molecular weight polyethylene, a liquid paraffin, an acid amide, stearic acid wax, montan series wax, sazol wax, montan wax, castor wax, chlorinated paraffin, carnauba wax, rice wax, candelilla wax, lanolin, ozokerite, beeswax, microcrystalline wax, and ester series wax.

In the developing agent of the present invention, it is possible to add a charge controlling agent such as nigrosine, azine based dye containing alkyl base having carbon number of 2 to 16, metal complex salt of monoazo dye, salicylic acid, and metal complex salt of dialkyl salicylic acid, as required.

EXAMPLE

The toner of the present invention can be prepared as follows. In the first step, 100 parts by weight of a binder resin and 1 to 10 parts by weight of a coloring agent are mixed and dispersed by using, for example, a nauta mixer, a ball mill, a V-shaped mixer or a Henschel mixer. Then, the mixture is heated, melted and kneaded by using, for example, a pressure kneader or a roll. The kneaded mass is finely pulverized by using a hammer mill, a jet mill or the like so as to obtain toner particles. Then, the toner particles are classified into particles having a desired diameter by, for example, an air classifying method. Further, additives are mixed with the classified toner particles by using, for example, a Henschel mixer so as to obtain a desired toner.

The toner thus obtained can be applied to all the known developing methods. The developing methods include, for example, two component developing methods such as a cascade method, a magnetic brushing method, or a micro toning method; a one component developing method containing a magnetic body such as a conductive one component developing method, an insulating one component developing method, or a jumping developing method; a powder cloud method; a fur brush method; and a nonmagnetic one component developing method in which the toner is electrostatically held on an image carrier so as to be transferred into a developing section for performing the development.

Toners were manufactured in Examples 1 to 7 and Comparative Examples 1 to 4 described below by employing the toner manufacturing methods described above.

Example 1

Unless otherwise noted, the term "part" means "part by weight".

A kneaded material was obtained by mixing 93 parts of a polyester resin having a number average molecular weight Mn of 3,500, a weight average molecular weight Mw of 130,000, and a ratio Mw/Mn of 3.71, 5 parts of pigment (azo series pigment) and 2 parts of a charge control agent (zirconia complex) in a Henschel mixture having an inner volume of 75 L(liters), followed by melting and kneading the mixture. The kneaded material thus obtained was roughly pulverized, followed by finely pulverizing the roughly pulverized material by using IDS-5 type (manufactured by Japan Pneumatic Inc.) so as to obtain toner particles having an average particle diameter of 7 $\mu$m.

100 parts of the toner particles thus obtained was put together with 0.4 part of hydrophobic silica in a Henschel mixer having an inner volume of 20 L, and the Henschel mixer was kept rotated at 2100 rpm for 5 minutes so as to achieve a sufficient mixing and, thus, to obtain toner.

The resultant toner was pelletized and an XRF analysis was applied to each of the front surface and the back surface of the resultant pellet. Table 1 shows the result.

Then, a developing agent was prepared by mixing 6 parts of the resultant toner with 94 parts of carrier, and images were formed on 20,000 sheets by using an image forming apparatus of magnetic brush type developing system. The filming resistance and the offset resistance of the images were visually examined. Table 1 also shows the results.

The filming resistance was measured by observing a half-tone image and a solid image after forming images 20,000 times. The mark ◎ in Table 1 denotes the best result. Also, the mark ○ denotes a satisfactory result. Further, the mark X denotes a poor result.

On the other hand, the offset resistance was measured by observing a solid image after forming images 20,000 times. The mark ◎ in Table 1 denotes the best result. Also, the mark ○ denotes a satisfactory result. Further, the mark X denotes a poor result.

Example 2

A kneaded material was obtained by mixing 88 parts of the polyester resin equal to that used in Example 1, 5 parts of pigment, 2 parts of a charge control agent, and 5 of rice wax in a Henschel mixer having an inner volume of 75 L, followed by melting and kneading the mixture. The kneaded material thus obtained was roughly pulverized, followed by finely pulverizing the roughly pulverized material by using IDS-5 type (manufactured by Japan Pneumatic Inc.) so as to obtain toner particles having an average particle diameter of 7 $\mu$m.

100 parts of the toner particles thus obtained was put together with 0.5 part of a hydrophobic silica in a Henschel mixer having an inner volume of 20 L, and the Henschel mixer was kept rotated at 2100 rpm for 5 minutes so as to achieve a sufficient mixing and, thus, to obtain toner.

The resultant toner was pelletized and an XRF analysis was applied to each of the front surface and the back surface of the resultant pellet. Table 1 shows the result.

Example 3

A kneaded material was obtained by mixing 93 parts of the polyester resin equal to that used in Example 1, 5 parts of pigment, and 2 parts of a charge control agent in a Henschel mixer having an inner volume of 75 L, followed by kneading the mixture. The kneaded material thus obtained was roughly pulverized, followed by finely pulverizing the roughly pulverized material by using IDS-5 type (manufactured by Japan Pneumatic Inc.) so as to obtain toner particles having an average particle diameter of 7 $\mu$m.

100 parts of the toner particles thus obtained was put together with 0.5 part of a hydrophobic silica in a Henschel mixer having an inner volume of 20 L, and the Henschel mixer was kept rotated at 2100 rpm for 10 minutes so as to achieve a sufficient mixing and, thus, to obtain toner.

The resultant toner was pelletized and an XRF analysis was applied to each of the front surface and the back surface of the resultant pellet. Table 1 shows the result.

Example 4

A kneaded material was obtained by mixing 93 parts of the polyester resin equal to that used in Example 1, 5 parts of pigment, and 2 parts of a charge control agent in a Henschel mixer having an inner volume of 75 L, followed by kneading the mixture. The kneaded material thus obtained was roughly pulverized, followed by finely pulverizing the roughly pulverized material by using IDS-5 type (manufactured by Japan Pneumatic Inc.) so as to obtain toner particles having an average particle diameter of 7 $\mu$m.

100 parts of the toner particles thus obtained was put together with 0.3 part of a hydrophobic silica in a Henschel mixer having an inner volume of 20 L, and the Henschel mixer was kept rotated at 2100 rpm for 10 minutes so as to achieve a sufficient mixing and, thus, to obtain toner.

The resultant toner was pelletized and an XRF analysis was applied to each of the front surface and the back surface of the resultant pellet. Table 1 shows the result.

Example 5

A kneaded material was obtained by mixing 93 parts of the polyester resin equal to that used in Example 1, 5 parts of pigment, and 2 parts of a charge control agent in a Henschel mixer having an inner volume of 75 L, followed by kneading the mixture. The kneaded material thus obtained was roughly pulverized, followed by finely pulverizing the roughly pulverized material by using IDS-5 type (manufactured by Japan Pneumatic Inc.) so as to obtain toner particles having an average particle diameter of 7 $\mu$m.

100 parts of the toner particles thus obtained was put together with 2.5 parts of a hydrophobic silica in a Henschel mixer having an inner volume of 20 L, and the Henschel mixer was kept rotated at 2100 rpm for 5 minutes so as to achieve a sufficient mixing and, thus, to obtain toner.

The resultant toner was pelletized and an XRF analysis was applied to each of the front surface and the back surface of the resultant pellet. Table 1 shows the result.

Example 6

A kneaded material was obtained by mixing 93 parts of the polyester resin equal to that used in Example 1, 5 parts of pigment, and 2 parts of a charge control agent in a Henschel mixer having an inner volume of 75 L, followed by kneading the mixture. The kneaded material thus obtained was roughly pulverized, followed by finely pulverizing the roughly pulverized material by using IDS-5 type (manufactured by Japan Pneumatic Inc.) so as to obtain toner particles having an average particle diameter of 7 μm.

100 parts of the toner particles thus obtained was put together with 2.5 parts of a hydrophobic silica in a Henschel mixer having an inner volume of 20 L, and the Henschel mixer was kept rotated at 2100 rpm for 10 minutes so as to achieve a sufficient mixing and, thus, to obtain toner.

The resultant toner was pelletized and an XRF analysis was applied to each of the front surface and the back surface of the resultant pellet. Table 1 shows the result.

Example 7

A kneaded material was obtained by mixing 93 parts of the polyester resin equal to that used in Example 1, 5 parts of pigment, and 2 parts of a charge control agent in a Henschel mixer having an inner volume of 75 L, followed by kneading the mixture. The kneaded material thus obtained was roughly pulverized, followed by finely pulverizing the roughly pulverized material by using IDS-5 type (manufactured by Japan Pneumatic Inc.) so as to obtain toner particles having an average particle diameter of 7 μm.

100 parts of the toner particles thus obtained was put together with 3.0 parts of a hydrophobic silica in a Henschel mixer having an inner volume of 20 L, and the Henschel mixer was kept rotated at 2100 rpm for 10 minutes so as to achieve a sufficient mixing and, thus, to obtain toner.

The resultant toner was pelletized and an XRF analysis was applied to each of the front surface and the back surface of the resultant pellet. Table 1 shows the result.

Comparative Example 1

A kneaded material was obtained by mixing 93 parts of the polyester resin equal to that used in Example 1, 5 parts of pigment, and 2 parts of a charge control agent in a Henschel mixer having an inner volume of 75 L, followed by kneading the mixture. The kneaded material thus obtained was roughly pulverized, followed by finely pulverizing the roughly pulverized material by using IDS-5 type (manufactured by Japan Pneumatic Inc.) so as to obtain toner particles having an average particle diameter of 7 μm.

100 parts of the toner particles thus obtained was put together with 0.5 part of a hydrophobic silica in a Henschel mixer having an inner volume of 20 L, and the Henschel mixer was kept rotated at 2100 rpm for 3 minutes so as to achieve a sufficient mixing and, thus, to obtain toner.

The resultant toner was pelletized and an XRF analysis was applied to each of the front surface and the back surface of the resultant pellet. Table 1 shows the result.

Comparative Example 2

A kneaded material was obtained by mixing 93 parts of the polyester resin equal to that used in Example 1, 5 parts of pigment, and 2 parts of a charge control agent in a Henschel mixer having an inner volume of 75 L, followed by kneading the mixture. The kneaded material thus obtained was roughly pulverized, followed by finely pulverizing the roughly pulverized material by using IDS-5 type (manufactured by Japan Pneumatic Inc.) so as to obtain toner particles having an average particle diameter of 7 μm.

100 parts of the toner particles thus obtained was put together with 2.0 parts of a hydrophobic silica in a Henschel mixer having an inner volume of 20 L, and the Henschel mixer was kept rotated at 2100 rpm for 3 minutes so as to achieve a sufficient mixing and, thus, to obtain toner.

The resultant toner was pelletized and an XRF analysis was applied to each of the front surface and the back surface of the resultant pellet. Table 1 shows the result.

Comparative Example 3

A kneaded material was obtained by mixing 93 parts of the polyester resin equal to that used in Example 1, 5 parts of pigment, and 2 parts of a charge control agent in a Henschel mixer having an inner volume of 75 L, followed by kneading the mixture. The kneaded material thus obtained was roughly pulverized, followed by finely pulverizing the roughly pulverized material by using IDS-5 type (manufactured by Japan Pneumatic Inc.) so as to obtain toner particles having an average particle diameter of 7 μm.

100 parts of the toner particles thus obtained was put together with 2.5 parts of a hydrophobic silica in a Henschel mixer having an inner volume of 20 L, and the Henschel mixer was kept rotated at 2100 rpm for 3 minutes so as to achieve a sufficient mixing and, thus, to obtain toner.

The resultant toner was pelletized and an XRF analysis was applied to each of the front surface and the back surface of the resultant pellet. Table 1 shows the result.

Comparative Example 4

A kneaded material was obtained by mixing 93 parts of the polyester resin equal to that used in Example 1, 5 parts of pigment, and 2 parts of a charge control agent in a Henschel mixer having an inner volume of 75 L, followed by kneading the mixture. The kneaded material thus obtained was roughly pulverized, followed by finely pulverizing the roughly pulverized material by using IDS-5 type (manufactured by Japan Pneumatic Inc.) so as to obtain toner particles having an average particle diameter of 7 μm.

100 parts of the toner particles thus obtained was put together with 3.0 parts of a hydrophobic silica in a Henschel mixer having an inner volume of 20 L, and the Henschel mixer was kept rotated at 2100 rpm for 3 minutes so as to achieve a sufficient mixing and, thus, to obtain toner.

The resultant toner was pelletized and an XRF analysis was applied to each of the front surface and the back surface of the resultant pellet. Table 1 shows the result.

Figure 4:
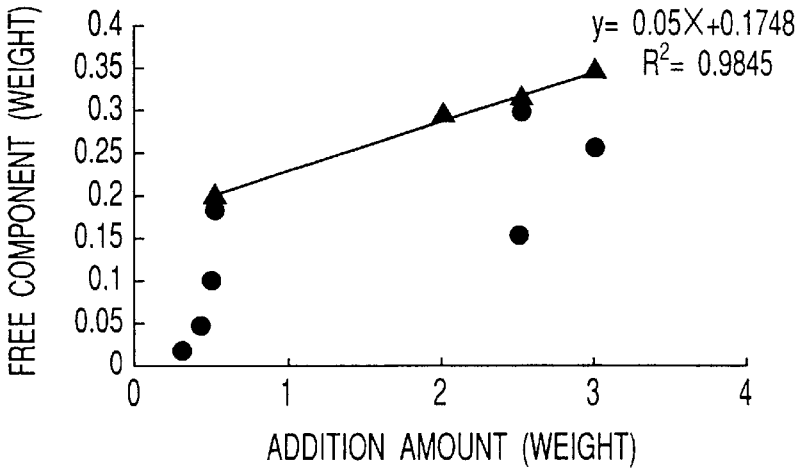
FIG. 4 is a graph showing the relationship between the free component content of the additive and the entire addition amount of the additive.

FIG. 4 is a graph showing the relationship between the free component content of the additive obtained from the difference in the additive amount between the front surface and the back surface of the developing agent pellet and the total amount of the additive with respect to the toner obtained each of the Examples and the Comparative Examples. The mark ● in FIG. 4 denotes Examples of the present invention, with the mark ▲ denoting the Comparative Examples.

TABLE 1

| | Addition amount (% by weight) | Amount on front surface | Amount on back surface | Free component | Filming | Offset |
|---|---|---|---|---|---|---|
| Example 1 | 0.400 | 0.412 | 0.366 | 0.046 | ○ | ○ |
| Example 2 | 0.500 | 0.679 | 0.489 | 0.190 | ○ | ◎ |
| Example 3 | 0.500 | 0.578 | 0.478 | 0.100 | ○ | ○ |
| Example 4 | 0.300 | 0.315 | 0.294 | 0.021 | ○ | ○ |
| Example 5 | 2.500 | 2.657 | 2.356 | 0.301 | ○ | ○ |
| Example 6 | 2.500 | 2.621 | 2.469 | 0.152 | ○ | ○ |
| Example 7 | 3.000 | 3.143 | 2.888 | 0.255 | ○ | ○ |
| Comparative Example 1 | 0.500 | 0.619 | 0.491 | 0.200 | X | ○ |

TABLE 1-continued

| | Addition amount (% by weight) | Amount on front surface | Amount on back surface | Free component | Filming | Offset |
|---|---|---|---|---|---|---|
| Comparative Example 2 | 2.000 | 2.278 | 1.978 | 0.300 | X | ○ |
| Comparative Example 3 | 2.500 | 2.678 | 2.367 | 0.311 | X | ○ |
| Comparative Example 4 | 3.000 | 3.307 | 2.963 | 0.344 | X | ○ |

As apparent from FIG. 4, the toner meeting the condition of $y<0.057x+0.1748$ (x: addition amount; y: free component; $x \geqq 0.2$) is free from the filming generation.

It has also been found that the ratio of the free component content to the total addition amount of the additive can be decreased by allowing the additive to be strongly attached to the toner when the additive is mixed with the toner. For example, it has been found that the ratio of the free component can be decreased by, for example, increasing the rotating speed of the mixer and by increasing the mixing time.

As described above, the present invention makes it possible to indicate quantitatively the attached state of the additive to the toner and also makes it possible to judge the presence or absence of the filming generation in the toner by using as the index the numerical formula given above.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing agent, comprising:

toner particles containing a binder resin and a colorant, said binder resin satisfying the conditions of:

$2{,}000 \leqq$ number average molecular weight $Mn \leqq 5{,}000$;

$8{,}000 \leqq$ weight average molecular weight $Mw \leqq 70{,}000$; and $1.6 \leqq Mw/Mn \leqq 35$; and an additive mixed with said toner particles, wherein said developing agent satisfies the relationship $y<0.057x+0.1748$, where x represents the total amount of the additive, which is not smaller than 0.2, and y represents the content of the free component of the additive.

2. The developing agent according to claim 1, wherein said additive is a hydrophobic silica.

3. The developing agent according to claim 1, wherein said binder resin is a polyester resin.

4. The developing agent according to claim 1, further comprising a charge controlling agent consisting of a zirconia complex.

* * * * *